US006684426B1

(12) United States Patent
Lin et al.

(10) Patent No.: US 6,684,426 B1
(45) Date of Patent: Feb. 3, 2004

(54) FOLDING COLLAPSIBLE MASSAGE BED

(75) Inventors: Lawrence Lin, Taichung (TW); Meng-Tsung Chen, Tainan (TW)

(73) Assignee: LifeGear, Inc., El Monte, CA (US)

( * ) Notice: Subject to any disclaimer, the term of this patent is extended or adjusted under 35 U.S.C. 154(b) by 0 days.

(21) Appl. No.: 10/225,694

(22) Filed: Aug. 22, 2002

(51) Int. Cl.[7] ..... A47B 3/00

(52) U.S. Cl. ..... 5/620; 5/622; 5/316; 108/36; 108/132

(58) Field of Search ..... 5/620, 622, 638, 5/110, 174, 179, 180, 725, 316; 190/2; 108/36, 132, 169

(56) References Cited

U.S. PATENT DOCUMENTS 1,785,342 A * 12/1930 Gilbert ..... 403/100
2,002,607 A * 5/1935 McDaniel ..... 5/99.1
4,333,638 A * 6/1982 Gillotti ..... 5/613
4,856,497 A * 8/1989 Westphal ..... 606/242
4,943,041 A * 7/1990 Romein ..... 5/620
5,009,170 A * 4/1991 Spehar ..... 108/36
5,524,555 A * 6/1996 Fanuzzi ..... 108/132
5,943,965 A * 8/1999 Riach et al. ..... 108/36
6,000,345 A * 12/1999 Gillotti ..... 108/36

* cited by examiner

*Primary Examiner*—Michael F. Trettel
(74) *Attorney, Agent, or Firm*—David L. Davis

(57) ABSTRACT

A folding collapsible massage bed constructed to include a bedstead formed of two equal open frames hinged together by leaved hinge means, two mattress elements respectively mounted on the open frames, two legs respectively pivoted to the open frames, two cord members bilaterally connected between the legs to limit the outward turning angle of the legs, four folding braces bilaterally symmetrically connected between the legs and hinge leaves of the hinge means, and locking means adapted for locking the folding braces in the extended position.

4 Claims, 8 Drawing Sheets

FOLDING COLLAPSIBLE MASSAGE BED

FIELD OF THE INVENTION

The present invention relates to massage beds and, more particularly, to a compact massage bed which may be collapsed by folding and is safe in use.

DESCRIPTION OF THE RELATED ART

A thorough massage feels good when you are tired. Massaging (rubbing and kneading) the muscles and joints make the muscles and joints work better. Various massage beds are well known. However, conventional massage beds are not highly movable and require much storage space when not in use because they are commonly not collapsible. Although some folding collapsible beds are commercially available, these folding beds are not convenient for carrying from place to place by hand when collapsed.

It would therefore be desirable to have a folding collapsible massage bed. It would also be desirable to have a folding collapsible massage bed which can be arranged into a box-like configuration which is convenient for carrying from place to place by hand.

SUMMARY OF THE INVENTION

According to the present invention, there is provided a folding collapsible massage bed which comprises a bedstead. The bedstead includes two equal open frames and hinge means connected between the open frames. The hinge means includes a pair of hinge leaves connected by a hinge pin. A mattress is supported on the bedstead, the mattress including two mattress elements of equal size, each mounted on a respective one of the open frames. A pair of leg members are each pivotally connected to a respective one of the open frames remote from the hinge means. Four folding braces are bilaterally symmetrically connected between the leg members and the hinge leaves of the hinge means. Each of the folding braces comprises a long bar having a first end pivoted to one hinge leaf of the hinge means, and a second end. Each of the folding braces also comprises a short bar having a first end pivoted to the second end of the long bar and a second end pivoted to one of the leg members, and lock means adapted for locking the long bar and the short bar when extended out. Two cord members are bilaterally connected between the leg members to limit the outward turning angle of the leg members relative to the open frame.

BRIEF DESCRIPTION OF THE DRAWINGS

The foregoing will be more readily apparent from reading the following description in conjunction with the drawings in which like elements in different figures thereof are identified by the same reference numerals and wherein.

DETAILED DESCRIPTION OF THE PREFERRED EMBODIMENT

Figure 1:
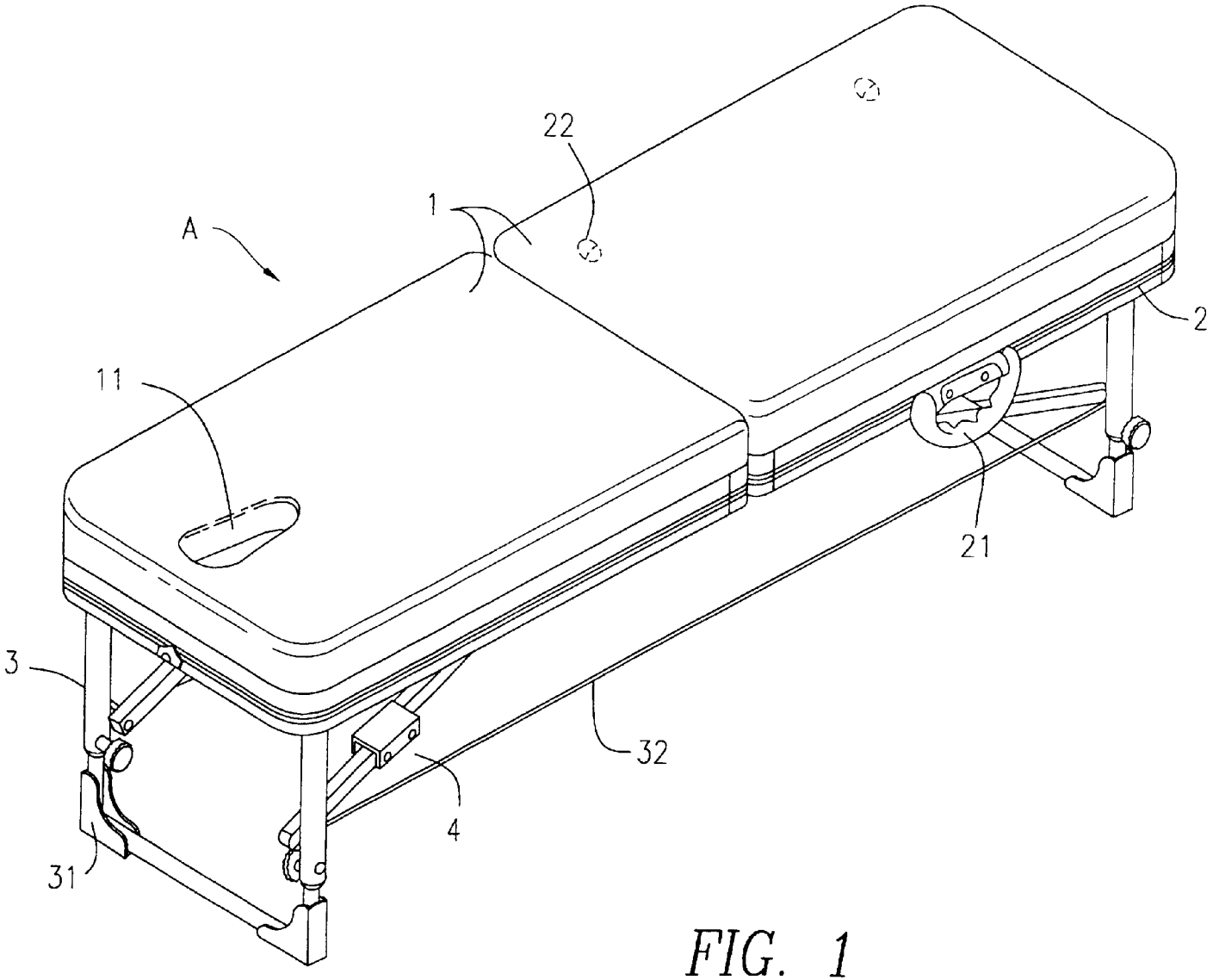
FIG. 1 is a perspective view of a first embodiment of the present invention, showing the folding collapsible massage bed in its extended operative configuration.
Figure 2:
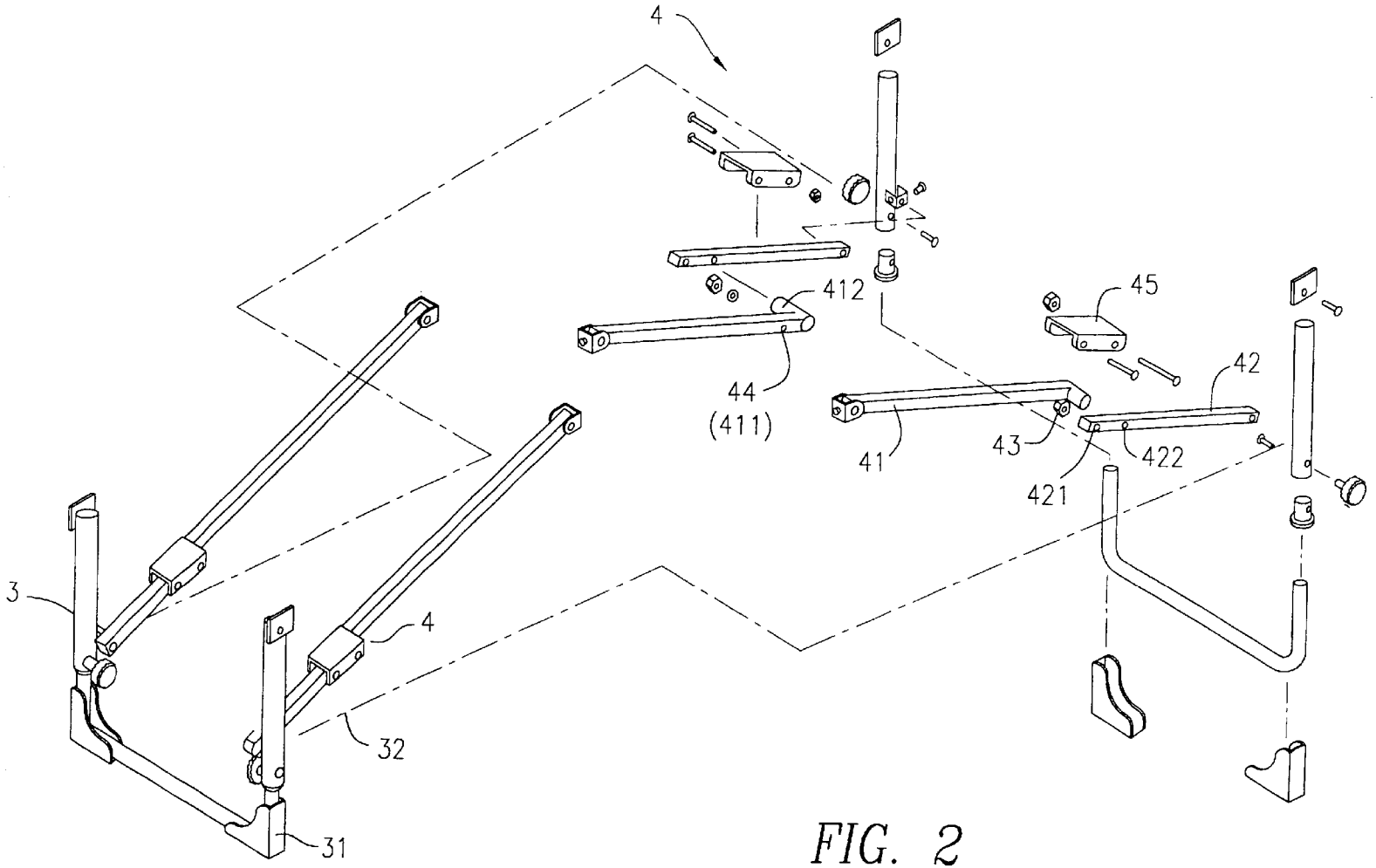
FIG. 2 is an exploded view of the leg members and the folding braces for the folding collapsible massage bed shown in FIG. 1.
Figure 3:
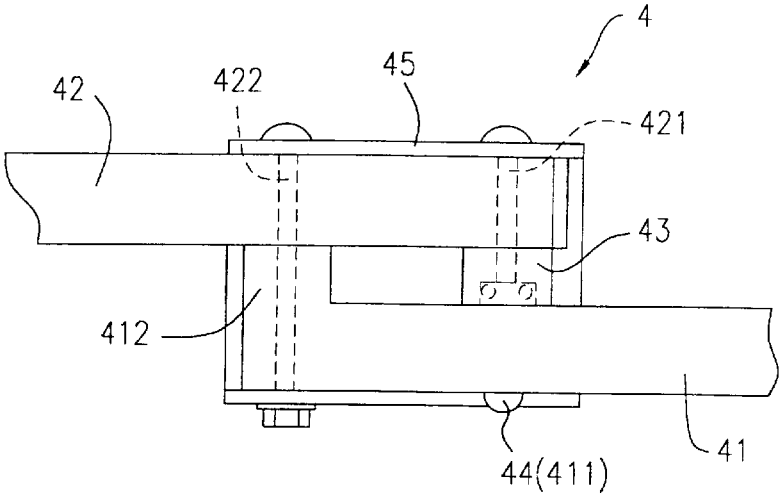
FIG. 3 is a sectional view of a part of one folding brace for the folding collapsible massage bed shown in FIG. 1.
Figure 4:
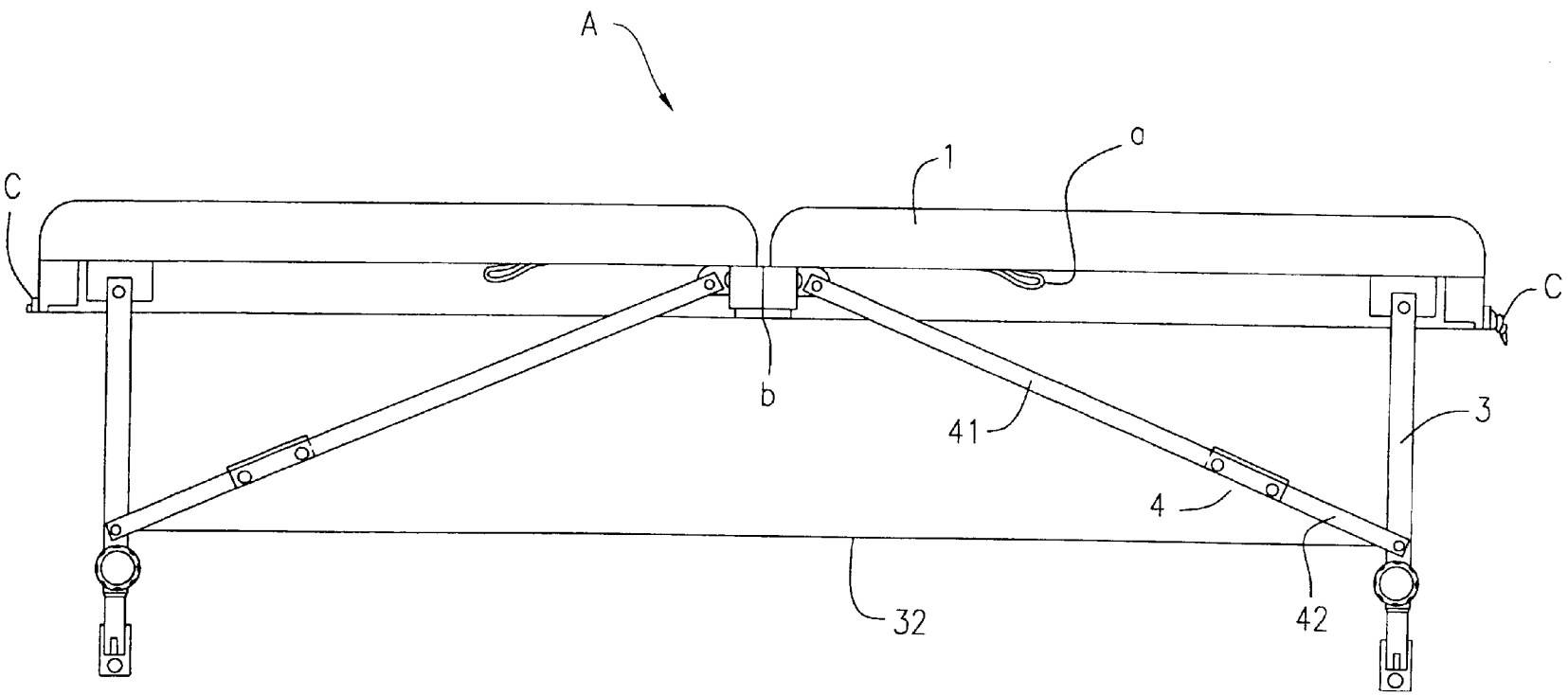
FIG. 4 is a side view of the folding collapsible massage bed shown in FIG. 1.

Referring to FIG. 1, a folding collapsible massage bed A is shown comprised of a mattress formed of two mattress elements 1 of equal size, a bedstead formed of two open frames 2 of equal size, two legs 3, and four folding braces 4. One mattress element 1 of the mattress has an opening 11 corresponding to the user mouth and nose. The open frames 2 of the bedstead are hinged together by hinges b (FIG. 4). One open frame 2 includes a handle 21 disposed at one lateral side, and a plurality of pegs 22 disposed at the other lateral side. The legs 3 are each respectively formed of a substantially U-shaped frame tube respectively pivoted to an open frame 2 of the bedstead, each leg 3 comprising a plurality of non-slip foot members 31 disposed at the bottom. Further, two cord members 32 are bilaterally connected between the legs 3 to limit the outward turning angle of the legs 3 relative to the bedstead. Referring to FIGS. 2 through 4 and FIG. 1 again, the folding braces 4 are bilaterally symmetrically connected between the legs 3 and the hinge leaves of the hinges b (each hinge is comprised of two hinge leaves pivotally connected together by a hinge pin). Each folding brace 4 is comprised of a long bar 41, a short bar 42, a friction pad 43, a spring-supported retaining steel ball 44, and a guard 45. The long bar 41 has a first end pivoted to one hinge leaf of one hinge b, and a second end pivoted to the short bar 42. The short bar 42 has a first end pivoted to the long bar 41, and a second end pivoted to one leg 3. The short bar 42 has a locating hole 421 disposed in the first end, and a pivot hole 422 disposed near the locating hole 421. The long bar 41 has an end rod 412 extended from the second end thereof at right angles and pivotally connected to the pivot hole 422 of the short bar 42 by pivot means, and a through hole 411 transversely disposed near the end rod 412. The guard 45 is pivotally connected to the pivot hole 422 of the short bar 42 and the end rod 412 of the long bar 41. The friction pad 43 is connected to the locating hole 421 of the short bar 41 and fixedly fastened to one sidewall of the guard 45. The spring-supported retaining steel ball 44 is mounted in the through hole 411 and is engaged into a hole (not shown) in the free end of the guard 45.

Figure 5:
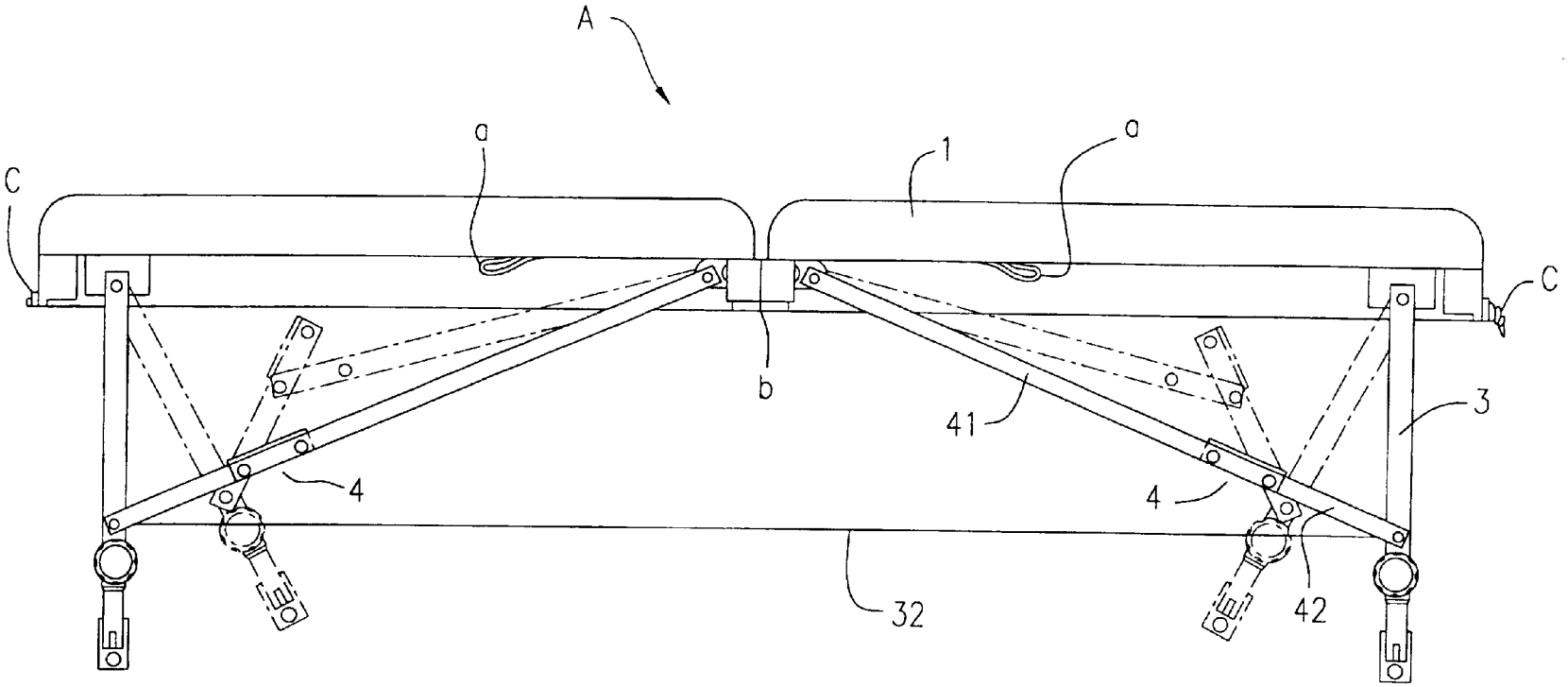
FIG. 5 is a schematic drawing showing the folding action of the folding collapsible massage bed shown in FIG. 1.
Figure 6:
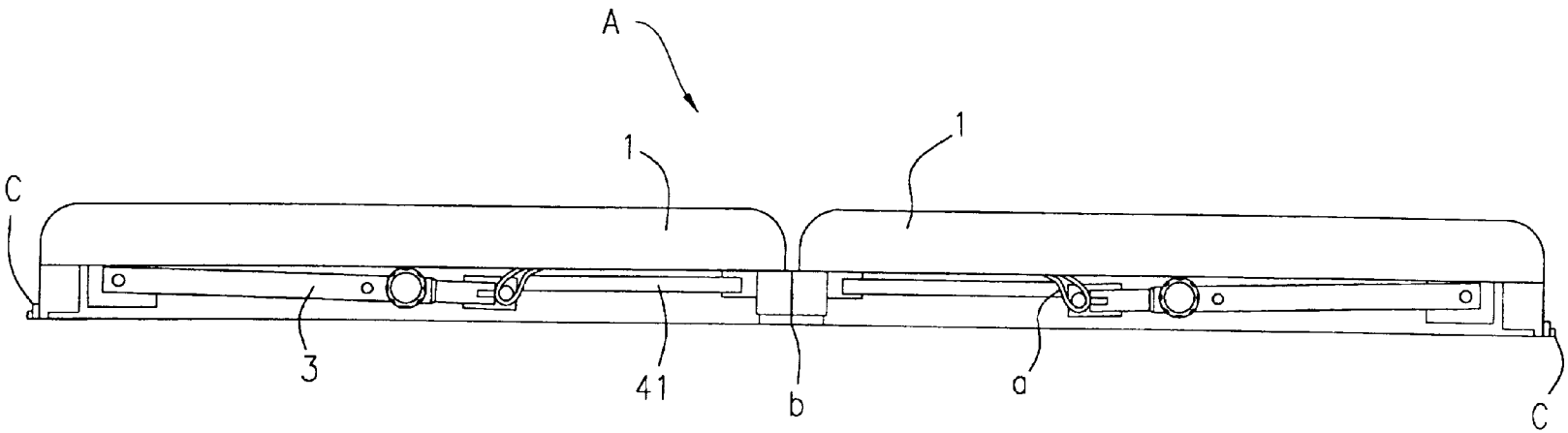
FIG. 6 illustrates the folding braces and the leg members folded up and closely respectively attached to the bottom sidewalls of the open frames according to the present invention.

Referring to FIGS. 5 and 6, when pressing the retaining steel ball 44 inwards to disengage the respective guard 45, the respective folding brace 4 is unlocked and can be folded up. FIG. 5 shows in broken lines the folding braces 4 unlocked and folded inwards, and the legs 3 respectively turned inwards toward the bottom sidewalls of the respective open frames 2. FIG. 6 shows the folding braces 4 and the legs 3 closely adjacent to the open frames 2. Further, hook and loop materials a are used to secure the legs 3 and the folding braces 4 to the bottom sidewalls of the open frames 2 respectively.

Figure 7:
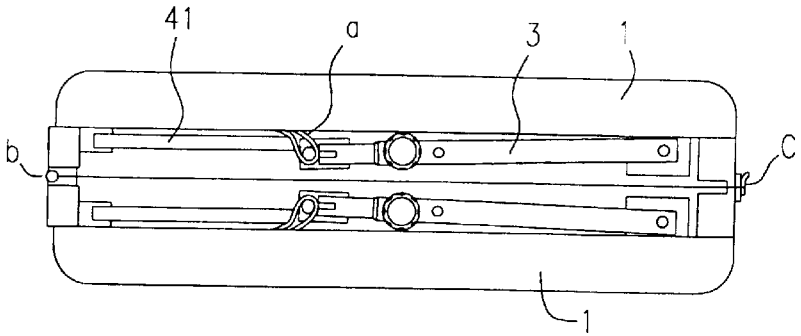
FIG. 7 shows the folding bed locked in the folded configuration.

Referring to FIG. 7, after the folding braces 4 and the legs 4 have been folded up and secured to the bottom sidewalls of the open frames 2 by the hook and loop materials a, the open frames 2 are folded up and secured in the collapsed configuration by snap fasteners c.

Referring to FIGS. 4 through 7 again, when in use, the snap fasteners c are unlocked, then the open frames 2 are extended out, and then the legs 3 are respectively extended out. When extending out the legs 3, the folding braces 4 are simultaneously moved and extended out. When the folding braces 4 are extended out, the spring-supported retaining steel balls 44 are respectively forced into engagement with the respective guards 45 to lock the respective folding braces 4 in the extended position, and therefore the folding collapsible massage bed A is set in its operative configuration.

Figure 8:
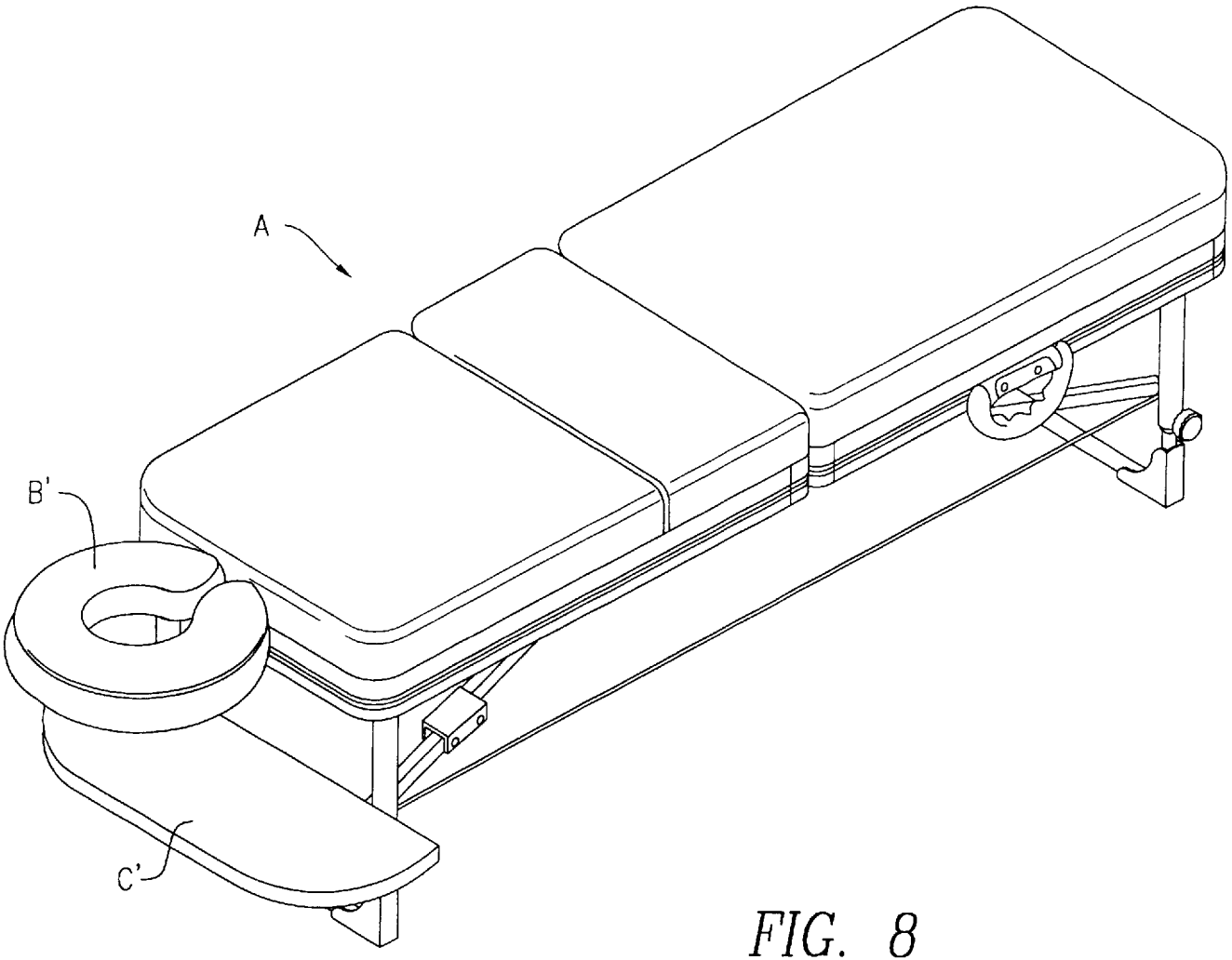
FIG. 8 is a perspective view of a first alternate embodiment of a folding collapsible massage bed according to the present invention.
Figure 9:
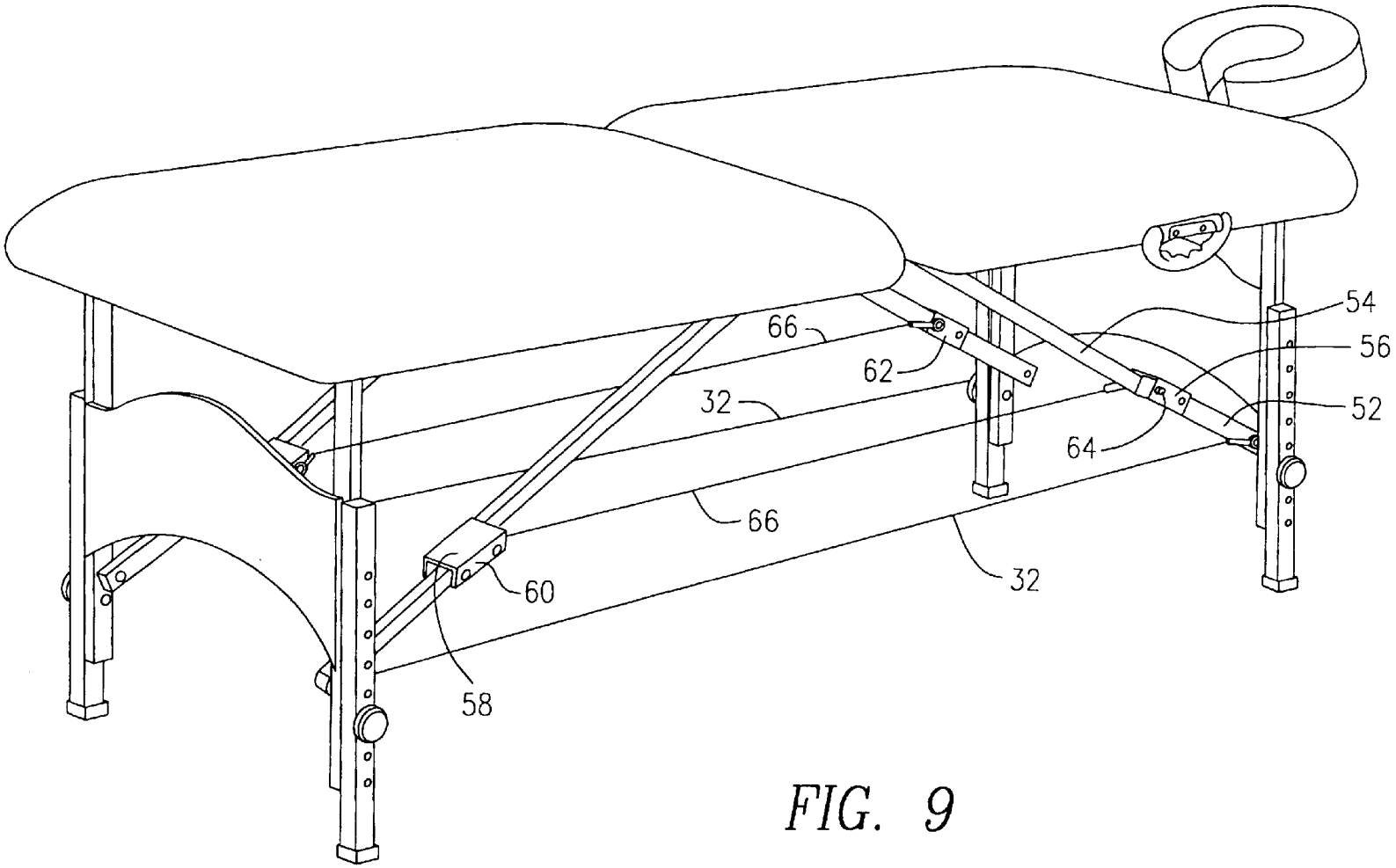
FIG. 9 is a perspective view of a second alternate embodiment of a folding collapsible massage bed according to the present invention.

FIG. 8 shows a first alternate embodiment of the present invention. According to this embodiment, the folding collapsible massage bed A comprises a headrest B provided at one end of one mattress element 1, and a hand board C provided at one leg 3 below the headrest B The embodiments shown in FIGS. 1–8 utilize aluminum tubing for the legs. It is often desired, for aesthetic purposes, to utilize wood for the legs and braces. It has been found that when using wood for the legs and braces the detents cannot be installed for the braces. The detents prevent the braces from folding upwardly. FIG. 9 shows a second alternate embodiment of the present invention wherein the legs and braces are made of wood and a substitute for the detents is provided.

As shown in FIG. 9, each of the braces includes a short bar 52 and a long bar 54, connected to the bedstead and legs as in the embodiment shown in FIGS. 1–8. A plate member 56 is provided for each of the four braces. The plate member 56 is bent so as to have a central portion 58 and two opposed parallel lateral portions 60, 62 which are orthogonal to the central portion 58. The lateral portion 60 is secured to the short bar 52 with the central portion overlying the first end of the short bar 52 and the second end of the long bar 54. A pivot pin 64 is utilized to pivotally connect together the short bar 52 and the long bar 54 and this pivot pin 64 extends through the short bar 52, the long bar 54, and the lateral portions 60, 62 of the plate member 56. In accordance with the embodiment shown in FIG. 9, in addition to the cord members which are bilaterally connected between the legs to limit the outward turning angle of the legs, there are provided two additional cord members 66 which are bilaterally connected between respective pairs of the pivot pins 64. This prevents the braces comprised of the bars 52, 54 from folding upward when the massage bed is in its operative state, as shown in FIG. 9.

The folding collapsible massage bed of the present invention achieves the following advantages:

1. The easy folding design enables the user to conveniently fold up the bed.

2. The folding braces provide a good support to the legs when the respective long and short bars are extended out and locked by the respective guards and spring-supported steel balls.

3. The simple folding structure of the folding collapsible bed is inexpensive to manufacture and easy to install.

4. The U-legs are strong enough to a support a heavy load on the mattress on the bedstead.

5. Hook and loop materials are provided for securing the legs and the folding braces positively to the bottom sidewalls of the open frames when the legs and the folding braces are folded up.

6. A handle is provided at one side of one open frame, which makes it convenient for the user to carry the folding collapsible massage bed in the collapsed configuration from place to place by hand.

7. When the folding collapsible bed is collapsed, it is set in a box-like configuration that requires less storage space.

Accordingly, there has been disclosed an improved folding collapsible massage bed. While illustrative embodiments of the inventive bed have been disclosed, it is understood that various modifications to the disclosed embodiments are possible, and it is intended that this invention be limited only by the scope of the appended claims.

What is claimed is:

1. A folding collapsible massage bed comprising:

a bedstead including two equal open frames and hinge means connected between said two open frames, said hinge means including a pair of hinge leaves connected by a hinge pin;

a mattress supported on said bedstead and including two mattress elements of equal size each mounted on a respective one of said two open frames;

a pair of leg members each pivotally connected to a respective one of said two open frames remote from said hinge means;

four folding braces bilaterally symmetrically connected between said pair of leg members and said hinge leaves of said hinge means, said folding braces each comprising a long bar having a first end pivoted to one hinge leaf of said hinge means and a second end, a short bar having a first end pivoted to the second end of said long bar and a second end pivoted to one of said leg members, and lock means adapted for locking said long bar and said short bar when extended out;

two cord members bilaterally connected between said leg members to limit the outward turning angle of said leg members relative to said open frames; and hook and loop materials provided at said open frames and adapted for securing said folding braces and said leg members to said open frames when said leg members and said folding braces are folded up.

2. The folding collapsible massage bed according to claim 1, further comprising snap fasteners provided at said open frames and adapted for securing the folding collapsible massage bed in a collapsed configuration when said folding braces and said leg members are secured to said open frames by said hook and loop materials and said open frames are folded up.

3. A folding collapsible massage bed comprising:

a bedstead including two equal open frames and hinge means connected between said two open frames, said hinge means including a pair of hinge leaves connected by a hinge pin;

a mattress supported on said bedstead and including two mattress elements of equal size each mounted on a respective one of said two open frames;

a pair of leg members each pivotally connected to a respective one of said two open frames remote from said hinge means;

four folding braces bilaterally symmetrically connected between said pair of leg members and said hinge leaves of said hinge means, said folding braces each comprising a long bar having a first end pivoted to one hinge leaf of said hinge means and a second end, a short bar having a first end pivoted to the second end of said long bar and a second end pivoted to one of said leg members, and lock means adapted for locking said long bar and said short bar when extended out; and two cord members bilaterally connected between said leg members to limit the outward turning angle of said leg members relative to said open frames;

wherein said short bar comprises a locating hole disposed in the first end thereof and a pivot hole disposed near said locating hole, said long bar comprises an end rod extended at right angles from the second end thereof and pivotally connected to the pivot hole of said short bar by pivot means and a through hole transversely disposed near said end rod corresponding to said locating hole of said short bar, said lock means comprising a guard, a friction pad, and a spring-supported retaining ball, said guard having a fixed end pivotally connected to the pivot hole of said short bar and the end rod of said long bar and a free end, said friction pad being connected to the locating hole of said short bar and fixedly fastened to one sidewall of the free end of said guard, said spring-supported retaining ball being mounted in the through hole of said long bar and adapted for engaging the free end of said guard.

4. A folding collapsible massage bed comprising:

a bedstead including two equal open frames and hinge means connected between said two open frames, said hinge means including a pair of hinge leaves connected by a hinge pin;

a mattress supported on said bedstead and including two mattress elements of equal size each mounted on a respective one of said two open frames;

a pair of leg members each pivotally connected to a respective one of said two open frames remote from said hinge means;

four folding braces bilaterally symmetrically connected between said pair of leg members and said hinge leaves of said hinge means, said folding braces each comprising a long bar having a first end pivoted to one hinge leaf of said hinge means and a second end, a short bar having a first end pivoted to the second end of said long bar and a second end pivoted to one of said leg members, and lock means adapted for locking said long bar and said short bar when extended out; and two cord members bilaterally connected between said leg members to limit the outward turning angle of said leg members relative to said open frames;

wherein said lock means comprises a plate member bent to have a central position and two opposed parallel lateral portions which are orthoginal to the central portion, the plate member having one of its lateral portions secured to said short bar with the central portion overlying the first end of the short bar and the second end of the long bar, and wherein the short bar is pivoted to the long bar by a pivot pin which extends through the long bar the short bar and the two lateral portions of the plate member; and said bed further comprises two cord members bilaterally connected between respective pairs of pivot pins.

* * * * *